US007546656B2

(12) United States Patent
Kim et al.

(10) Patent No.: US 7,546,656 B2
(45) Date of Patent: Jun. 16, 2009

(54) METHOD OF INSTALLING PREFABRICATED, SEGMENT CONCRETE FILLED TUBE MEMBERS

(75) Inventors: Seong-woon Kim, Seoul (KR); Young-jin Kim, Gyeonggi-do (KR); In-gyu Kim, Gyeonggi-do (KR); Byeong-moo Jin, Gyeonggi-do (KR); Tae-hoon Kim, Gyeonggi-do (KR); Hyang-wook Ma, Seoul (KR); Yun-seok Lee, Seoul (KR)

(73) Assignee: Daewoo Engineering & Construction Co., Ltd, Jung-Gu (KR)

( * ) Notice: Subject to any disclaimer, the term of this patent is extended or adjusted under 35 U.S.C. 154(b) by 482 days.

(21) Appl. No.: 11/430,860

(22) Filed: May 10, 2006

(65) Prior Publication Data

US 2007/0039283 A1 Feb. 22, 2007

(30) Foreign Application Priority Data

Aug. 16, 2005 (KR) ..... 10-2005-0074639
Dec. 12, 2005 (KR) ..... 10-2005-0121674

(51) Int. Cl.
*E01D 21/00* (2006.01)
*E01D 22/00* (2006.01)

(52) U.S. Cl. ..... 14/77.1; 14/75; 14/77.3

(58) Field of Classification Search ..... 14/77.1, 14/77.3, 75; 277/602–607
See application file for complete search history.

(56) References Cited

U.S. PATENT DOCUMENTS 1,340,397 A * 5/1920 Nagel ..... 405/233
1,471,124 A * 10/1923 Handl ..... 405/250
1,588,516 A * 6/1926 Barnes ..... 405/257
1,759,786 A * 5/1930 Hardin ..... 405/250
2,426,477 A * 8/1947 Walton ..... 405/218
2,706,498 A * 4/1955 Upson ..... 285/290.4
3,720,068 A * 3/1973 DeRosa ..... 405/195.1
3,762,173 A * 10/1973 Marsh ..... 405/249
3,920,268 A * 11/1975 Stewing ..... 285/21.1
3,931,716 A * 1/1976 Payne ..... 405/252
4,211,503 A * 7/1980 Peterson et al. ..... 405/211.1
4,252,473 A * 2/1981 Thomas et al. ..... 405/250
4,492,796 A * 1/1985 Lorenz ..... 548/471
4,525,102 A * 6/1985 Gillen ..... 405/232
5,228,807 A * 7/1993 Willcox, Jr. ..... 405/232
5,327,694 A * 7/1994 Gamel et al. ..... 52/834
5,577,857 A * 11/1996 Miyasaka et al. ..... 403/316
5,593,251 A * 1/1997 Gillen ..... 405/250
5,800,889 A * 9/1998 Greene ..... 428/36.91
6,123,485 A * 9/2000 Mirmiran et al. ..... 405/252
6,131,265 A * 10/2000 Bird ..... 29/507
6,663,322 B1 * 12/2003 Listle ..... 405/239

* cited by examiner

*Primary Examiner*—Raymond W Addie
(74) *Attorney, Agent, or Firm*—Dickstein Shapiro LLP

(57) ABSTRACT

A method of installing segmental concrete filled tube members. The prefabricated segmental concrete filled tube member has a hollow pipe filled therein with concrete, and a connection flange shaped in a ring radially extending from the peripheries of both ends of the pipe, wherein the segmental concrete filled tube member is integrally connected with another adjacent segmental concrete filled tube member by the connection flange.

1 Claim, 12 Drawing Sheets

METHOD OF INSTALLING PREFABRICATED, SEGMENT CONCRETE FILLED TUBE MEMBERS

CROSS-REFERENCE TO RELATED APPLICATIONS

This application claims all benefits of Korean Patent Applications No. 2005-74639 filed on Aug. 16, 2005 and No. 2005-121674 filed on Dec. 12, 2005 in the Korean Intellectual Property Office, the disclosures of which are incorporated herein by reference.

BACKGROUND OF THE INVENTION

1. Field of the invention

The present invention relates to a prefabricated segmental concrete filled tube member, and fabrication structure and method using the same, and more particularly, to a prefabricated segmental concrete filled tube member capable of being easily assembled in short time for use in a bridge pier or a main girder, and so on, and fabrication structure and method using the same.

2. Description of the Prior Art

Members used in a bridge pier or a main girder and so on have been generally constructed with concrete structures. However, since such concrete structures are constructed at in situ site, there are drawbacks in that works are very complicated and it takes a considerable term of works.

Generally concrete filled tube bridge girders are very difficult to be filled with concrete in tube at site. Because ordinary concrete filled tube girders must be filled with concrete at the same time in whole members and they need for equipments for filling work. So it's not efficient in bridge member.

In case of a high bridge pier, which may be executed as a concrete pillar by using a slip form method and the like, since it should be executed at a high altitude, works are risky and work efficiency becomes degraded.

SUMMARY OF THE INVENTION

Accordingly, the present invention has been made to solve the above-mentioned problems occurring in the prior art, and an object of the present invention is to provide a fabrication structure capable of minimizing complicated in-site works to considerably shorten a term of works as compared with a cast-in-place concrete structure of the prior art.

Another object of the present invention is to provide a fabrication structure having greater rigidity for a vibration load or an axial load, as compared with a concrete structure of the prior art.

Still another object of the present invention is to provide a new constructing method that upon constructing a structure such as a bridge pier, prevents works at a high altitude to provide a safe, economical construction.

In order to accomplish the above objects, there is provided a prefabricated segmental concrete filled tube member comprising: a hollow pipe filled therein with concrete; and a connection flange shaped in a ring radially extending from the peripheries of both ends of the pipe, wherein the segmental concrete filled tube member is integrally connected with another adjacent segmental concrete filled tube member by the connection flange.

In such prefabricated segmental concrete filled tube member, the connection flange may be provided with a radial groove so that when adjacent prefabricated segmental concrete filled tube members are connected with each other, an injection hole is formed by the radial grooves of the opposite connection flanges so as to fill therethrough a filler material in a micro space possibly generated in the concrete filled in the pipe.

In such prefabricated segmental concrete filled tube member, the pipe may be provided therein with a sheath tube in which a tendon is installed.

In such prefabricated segmental concrete filled tube member, the pipe may be bent with a specified radius of curvature.

In accordance with another aspect of the present invention, there is provided a fabrication structure comprising two or more prefabricated segmental concrete filled tube members, wherein adjacent prefabricated segmental concrete filled tube members are connected with each other in such a way that the adjacent connection flanges are brought into contact with each other, and a filler material is injected through an injection hole formed by grooves provided on opposite surfaces of the adjacent connection flanges, respectively, thereby connecting the adjacent prefabricated segmental concrete filled tube members into one piece.

In such fabrication structure, a sheath tube may be installed in the concrete filled in the pipe so as to install a tendon therein, thereby introducing prestress in the fabrication structure during fabricating.

In accordance with still another aspect of the present invention, there is provided a fabrication method of a fabrication structure, comprising the steps of: (a) lifting a prefabricated coping part of the upper portion of a bridge pier to a desired level; (b) installing a prefabricated segmental concrete filled tube member under the coping part; (c) installing another prefabricated segmental concrete filled tube member under the former prefabricated segmental concrete filled tube member to connect each other such that a connection flange of the latter segmental concrete filled tube member brings in contact with that of the former segmental concrete filled tube member, (d) injecting a filler material into an injection hole formed by the grooves provided on opposite surfaces of the connection flanges, respectively, and (e) repeating the steps (c) and (d).

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a detailed construction and embodiments of the present invention will be described with reference to the accompanying drawings.

Figure 1:
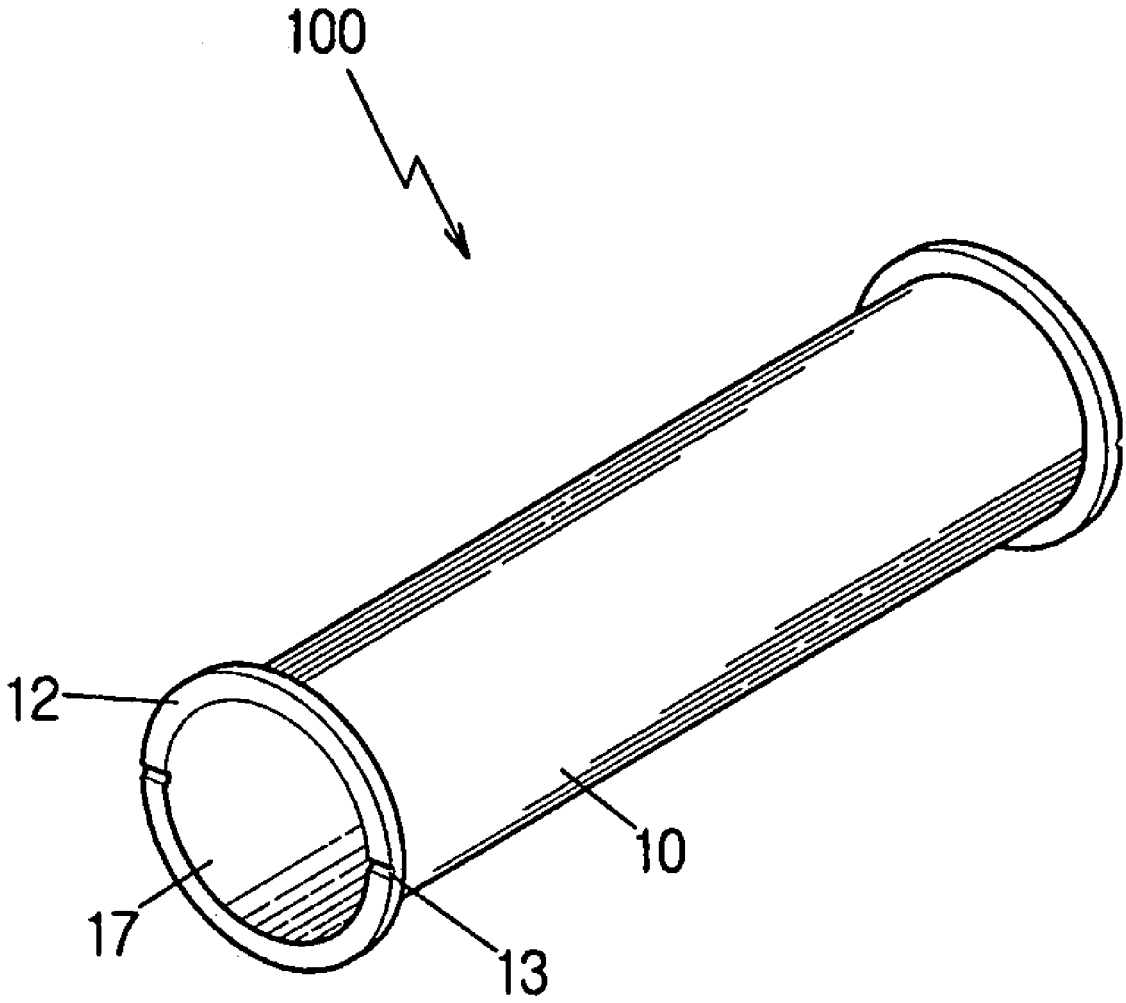
FIG. 1 is a perspective view of a prefabricated segmental concrete filled tube member, which is in a state where the concrete is not filled in a pipe thereof, according to a preferred embodiment of the present invention.
Figure 2:
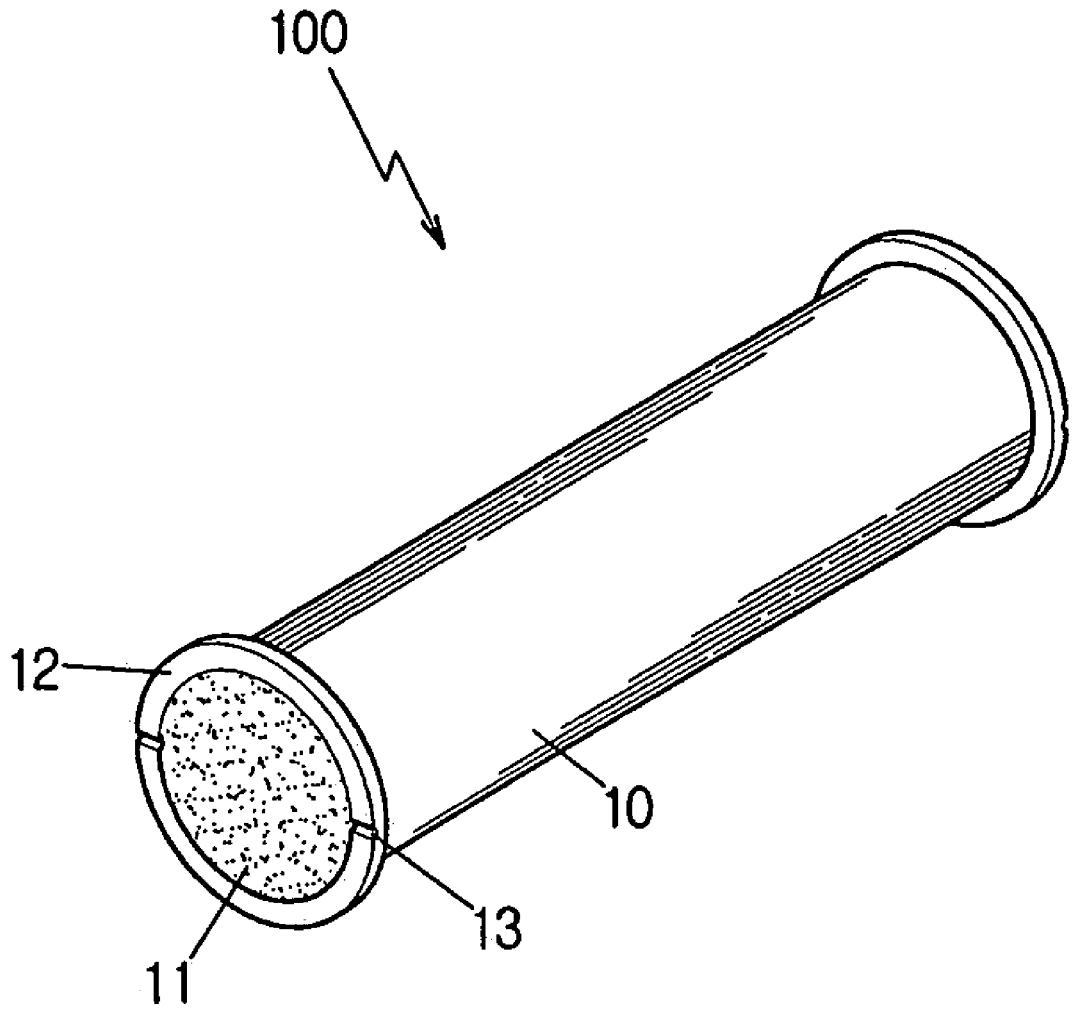
FIG. 2 is a perspective view of a prefabricated segmental concrete filled tube member, which is in a state where the concrete is filled in a pipe thereof, according to a preferred embodiment of the present invention.

FIG. 1 is a perspective view of a prefabricated segmental concrete filled tube member 100, which is in a state where the concrete is not filled in a hollow portion 17 of a pipe 10 thereof, according to a preferred embodiment of the present invention, and FIG. 2 is a perspective view illustrating a state where the concrete is filled in the pipe 10.

As shown in FIGS. 1 and 2, the prefabricated segmental concrete filled tube member 100 of the present invention includes a hollow pipe 10 to be filled with the concrete 11, and a connection flange 12 installed at both ends of the pipe 10. The connection flange 12 is shaped in a ring radially extending from the peripheries of both ends of the pipe 10. When the prefabricated segmental concrete filled tube member 100 is connected with another adjacent prefabricated segmental concrete filled tube member, the connection flanges 12 of the respective segmental concrete filled tube members are brought in contact with each other. The connection flange 12 is provided with a radial groove 13 in its front surface. When the adjacent prefabricated segmental concrete filled tube members are connected together, the grooves 13 provided on the adjacent connection flanges 12, respectively, form an injection hole 14 (See FIG. 4) through which a filler material is filled between the prefabricated segmental concrete filled tube members 100.

In a preferred embodiment of the invention, the pipe 10 may be a steel pipe, for example, however, the material of the pipe 10 is not limited thereto, so it may be other construction material, such as a fiber reinforced plastic (FRP).

The prefabricated segmental concrete filled tube member 100 of the present invention may be fabricated in a factory. That is, the prefabricated segmental concrete filled tube member is fabricated in a factory in such a manner that a pipe 10 having the connection flanges 12 installed at both ends thereof is prepared, and a concrete is filled in the hollow portion 17 of the pipe 10 and cured to form a prefabricated segmental concrete filled tube member 100. Like this, to fabricate the prefabricated segmental concrete filled tube member 100 in a factory makes it possible to facilitate the quality management, to fabricate fast in a large scale, and to prevent a complicated process due to fabrication in place.

The segmental concrete filled tube members 100 as fabricated in a factory are transported to a construction field and connected with each other to build a fabrication structure such as a pier or girder of a bridge.

Figure 3:
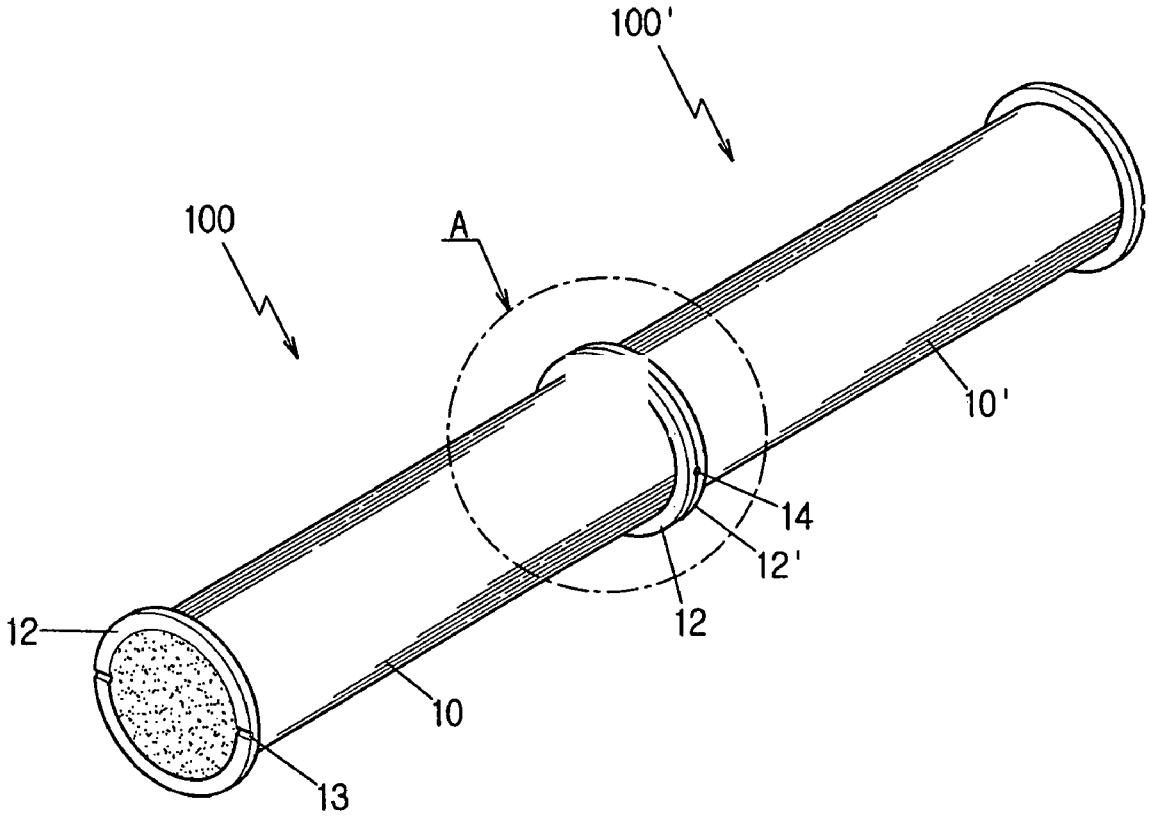
FIG. 3 is a perspective view illustrating a state where the prefabricated segmental concrete filled tube members shown in FIG. 1 are connected with each other.

FIG. 3 is a perspective view illustrating a fabrication structure built by the connection of the prefabricated segmental concrete filled tube members according to the preferred embodiment of the invention.

Referring to FIG. 3, the adjacent prefabricated segmental concrete filled tube members 100 and 100' are arranged in series such that the adjacent connection flanges 12 and 12' are brought in contact with each other, and the abutted connection flanges 12 and 12' are welded or bolted together to integrally connect the adjacent prefabricated segmental concrete filled tube members 100 and 100'.

In this case, a micro space may be generated in the connection portion of the adjacent prefabricated segmental concrete filled tube members 100 and 100'. That is, when both prefabricated segmental concrete filled tube members 100 and 100' are connected together, a space may be generated by a micro gap between the concretes 11 in the pipes 10 and 10'. In the present invention, a filler material such as un-constriction type mortar is filled in the micro space of the connection portion to maintain the continuity between the adjacent prefabricated segmental concrete filled tube members 100 and 100'.

Figure 4:
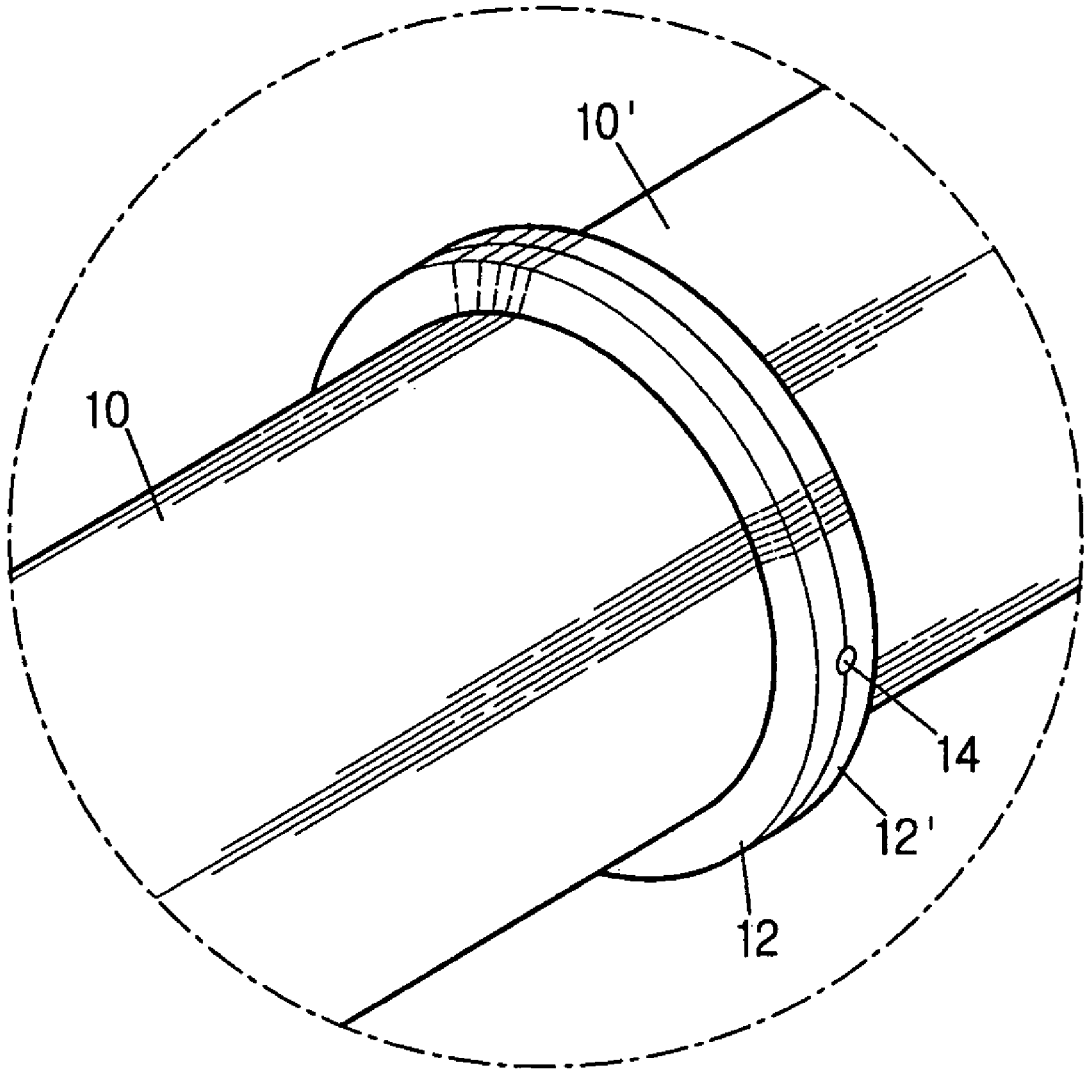
FIG. 4 is an enlarged view of A section in FIG. 3.

FIG. 4 is an enlarged view of A section in FIG. 3. In FIG. 4, an injection hole 14 is provided between the adjacent connection flanges 12 and 12' to inject a filler material therethrough. As described above, the injection hole 14 is formed by the radial grooves 13 (see FIG. 2) provided on the front of the adjacent connection flanges 12 and 12', respectively.

That is, as shown in FIG. 4, when both pipes 10 and 10' are connected such that the connection flanges 12 and 12' are brought in contact with each other, the injection hole 14 are formed by the grooves 13 provided on the connection flanges 12 and 12', and the filler material such as un-constriction type mortar is injected therethrough and filled in the micro space in the connection portion to thus maintain the continuity between the both prefabricated segmental concrete filled tube members 100 and 100'. In the mean time, if air is filled in the micro space, the filler material is hardly injected therein so that an additional vent hole may be formed to discharge air in the micro space.

Figure 5:
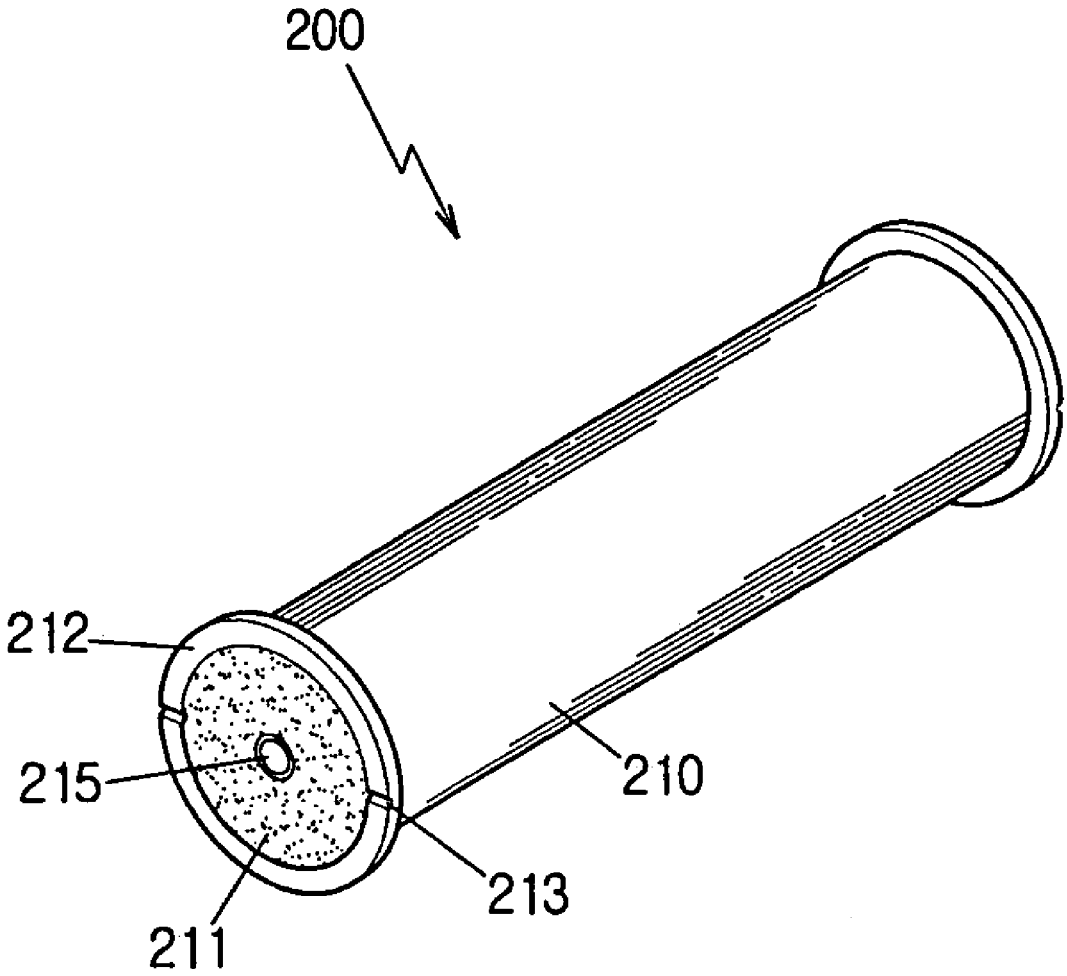
FIG. 5 is a perspective view of a prefabricated segmental concrete filled tube member according to another embodiment of the present invention.

FIG. 5 is a perspective view of a prefabricated segmental concrete filled tube member according to another embodiment of the present invention.

Referring to FIG. 5, the present embodiment is different from that of FIG. 2 in that a sheath tube 215 is included in the pipe 210 in order to install tendon 216 (see FIG. 6) therein. The difference will now be explained.

A prefabricated segmental concrete filled tube member 200 according to the embodiment of FIG. 5 is fabricated such that the sheath tube 215 is disposed in the pipe 210 before the concrete 211 is filled therein, and the concrete is then filled therein and cured to provide the prefabricated segmental concrete filled tube member 200. Meanwhile, although FIG. 5 illustrates that the sheath tube 215 is positioned at the center of the pipe 210, the position is not limited thereto, so the sheath tube 215 can be positioned in proper at a location where bending stress is generated according to a feature of a structure. A fabrication structure in which such prefabricated segmental concrete filled tube members 200 are connected together is shown in detain in FIG. 6.

Figure 6:
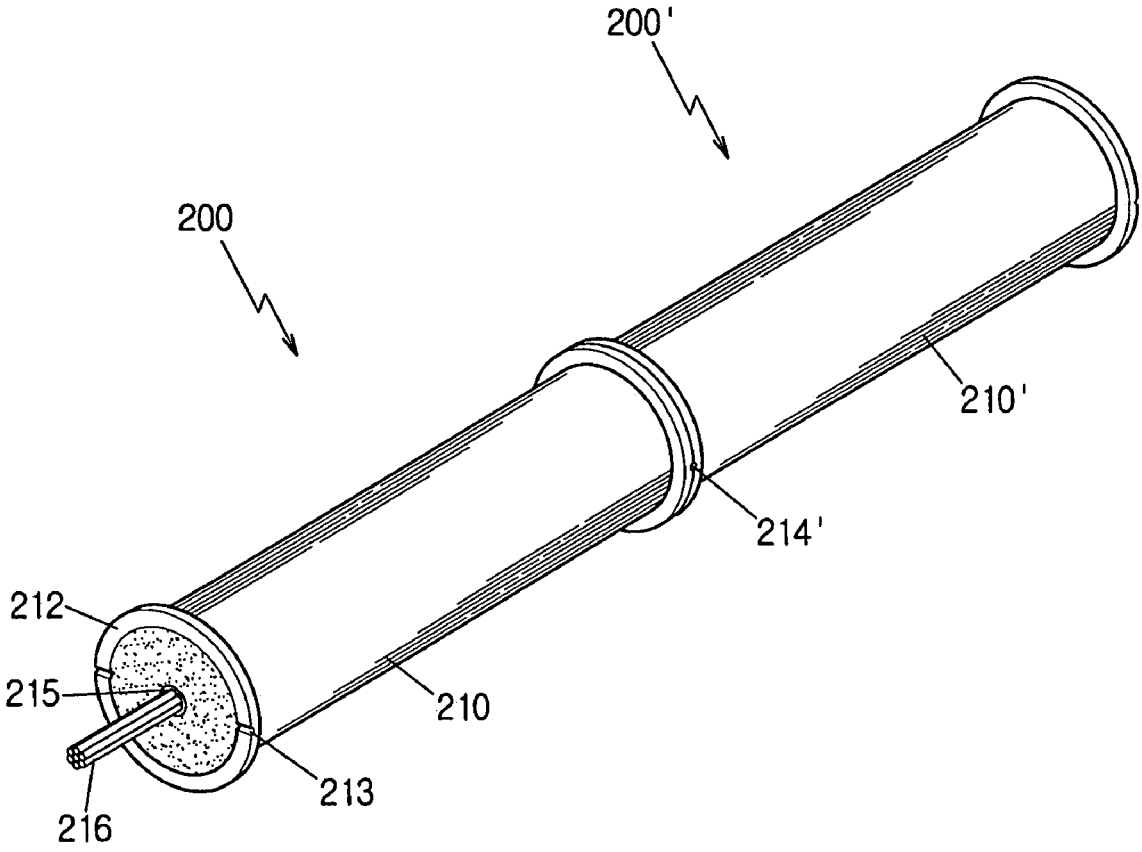
FIG. 6 is a perspective view illustrating a state where the prefabricated segmental concrete filled tube members shown in FIG. 5 are connected with each other.

In FIG. 6, in assembling the prefabricated segmental concrete filled tube members 200 and 200' together according to the present embodiment, the adjacent prefabricated segmental concrete filled tube members 200 and 200' are connected in series with each other, the tendon 216 is inserted into the sheath tube 215 to install, and the tendon 216 is then prestressed to apply prestress to the fabrication structure formed by the prefabricated segmental concrete filled tube members 200 and 200'. The connection method of the prefabricated segmental concrete filled tube members 200 and 200' is similar to that of FIG. 3, so the detailed explanation thereof will be omitted.

Figure 7:
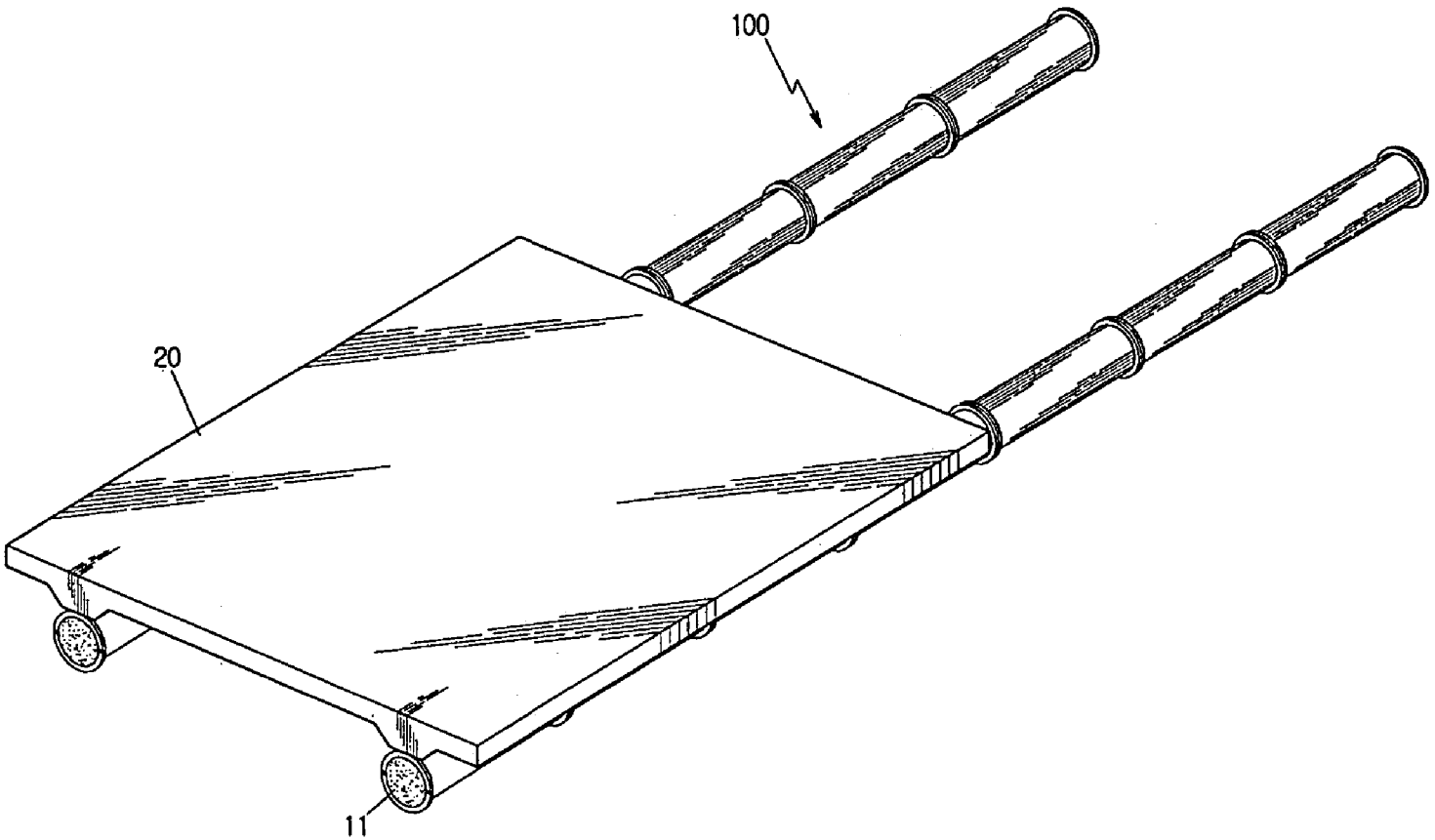
FIG. 7 is a schematic perspective view illustrating an example of adapting a fabrication structure by the prefabricated segmental concrete filled tube members to a main girder of a bridge.

FIG. 7 is a perspective view illustrating an example of adapting a fabrication structure by the prefabricated segmental concrete filled tube members 100 to a main girder of a bridge. As described above, such fabrication structure is built by in-site connection and assembly of the plurality of prefabricated segmental concrete filled tube members 100 that have been prefabricated in proper length in a factory. In FIG. 7, a reference numeral 20 denotes a floor slab to be installed on the girder formed by the connection of the prefabricated segmental concrete filled tube members 100. In the prefabricated segmental concrete filled tube member 100 in FIG. 7, although the tendon 216 is not illustrated, if necessary, the sheath tube 215 is installed in the segmental concrete filled tube member 200 of FIG. 6, i.e., the pipe 210, and the tendon 216 is then disposed therein, so that the fabrication structure can also be prestressed.

By employing such prefabricated segmental concrete filled tube members 100 and 200 according to the present invention, any pillar structure such as a bridge pier, a power transmission tower and so on, which is applied with an axial force can be easily fabricated. In particular, by using the prefabricated segmental concrete filled tube members 100 and 200, the whole body pillar structure 1 can be built with the assembly in series of the prefabricated segmental concrete filled tube members 100 and 200. The detailed contents of the fabrication method of the fabrication structure 1 will be explained with reference to an example of execution of the bridge pier.

Figure 8:
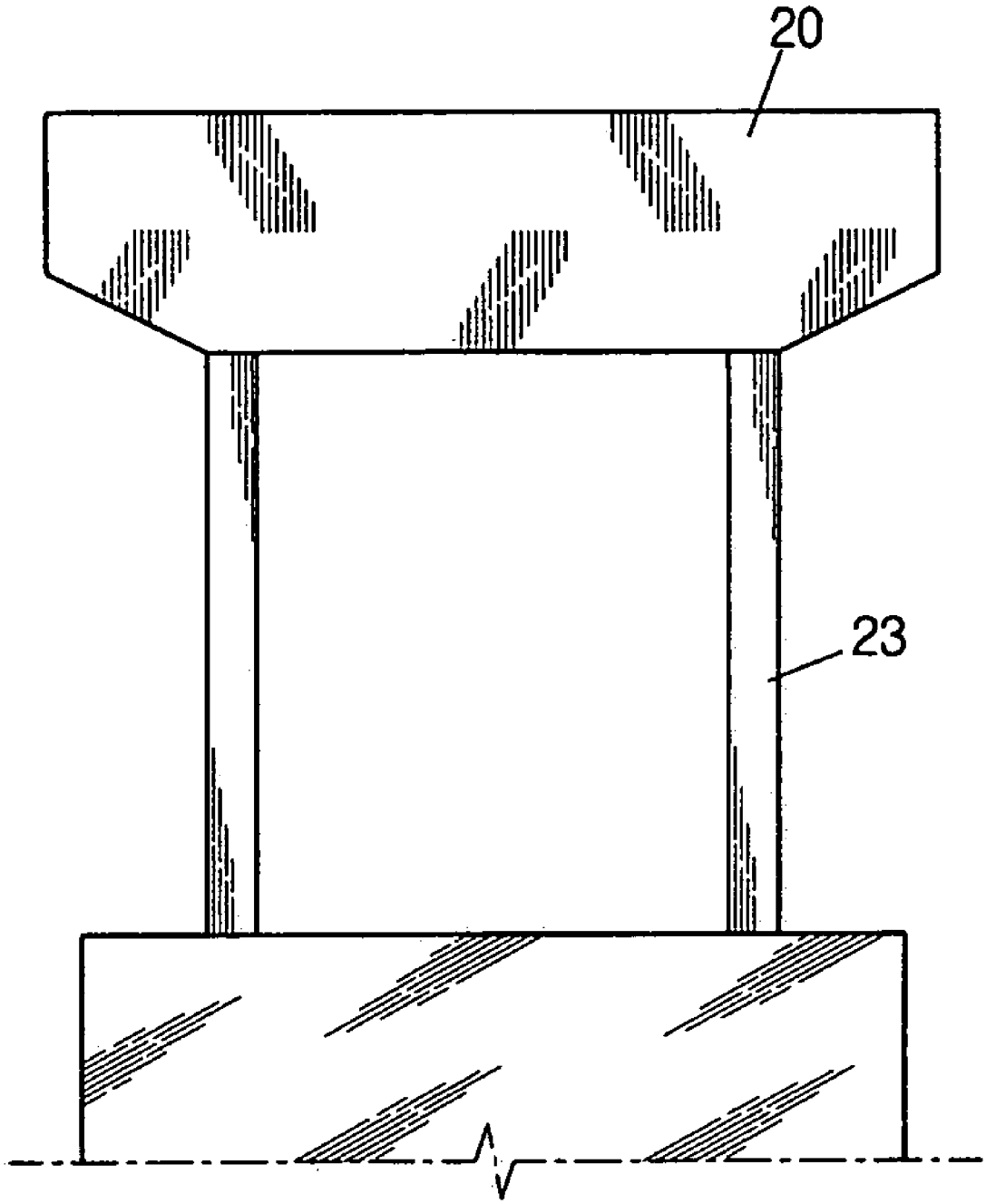
FIG. 8 is a front view illustrating a state where a prefabricated coping part of the upper portion of the pier is lifted according to a fabrication method of a fabrication structure by the prefabricated segmental concrete filled tube members of the present invention.
Figure 9:
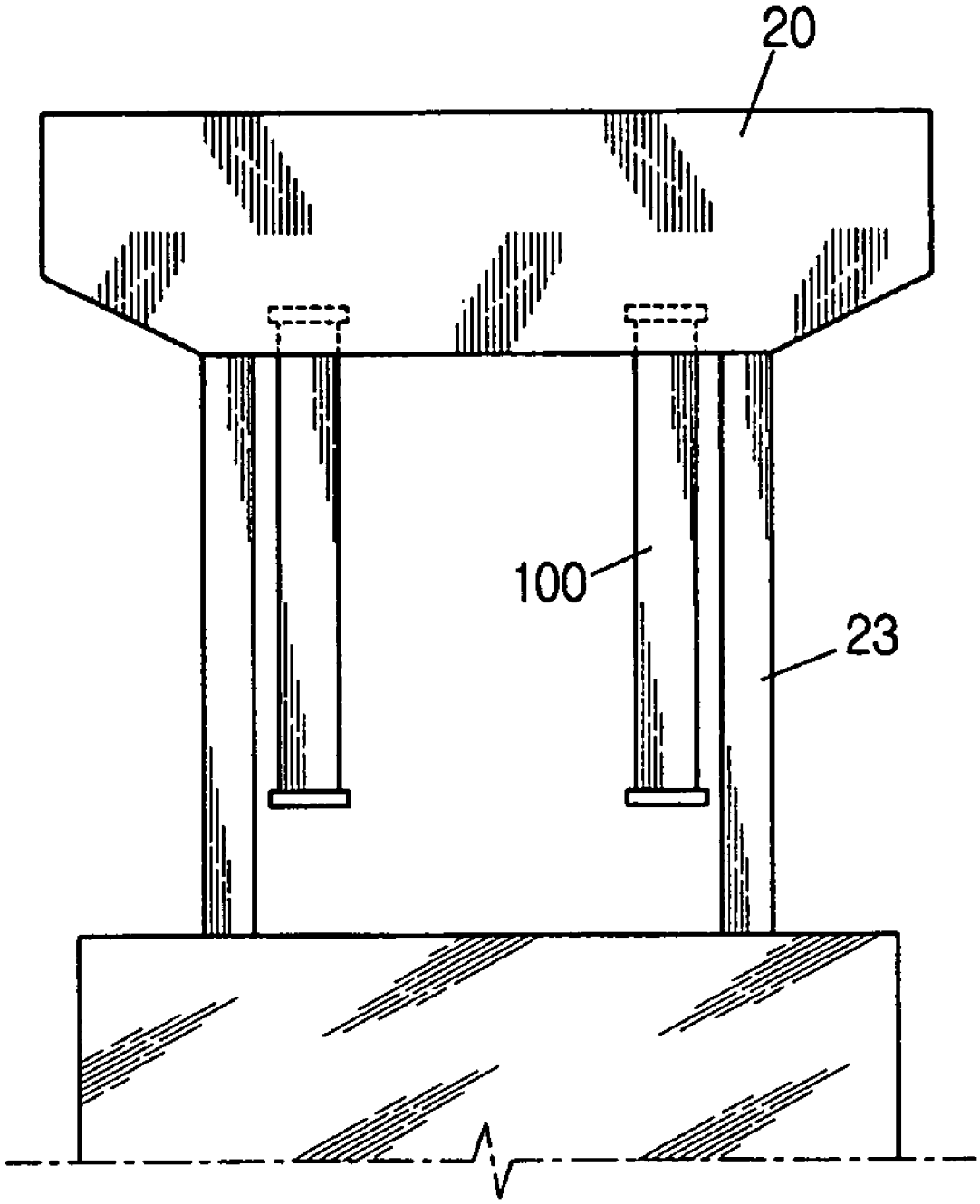
FIG. 9 is a front view illustrating a state where a prefabricated segmental concrete filled tube member of the present invention is installed under the coping part of FIG. 8.
Figure 10:
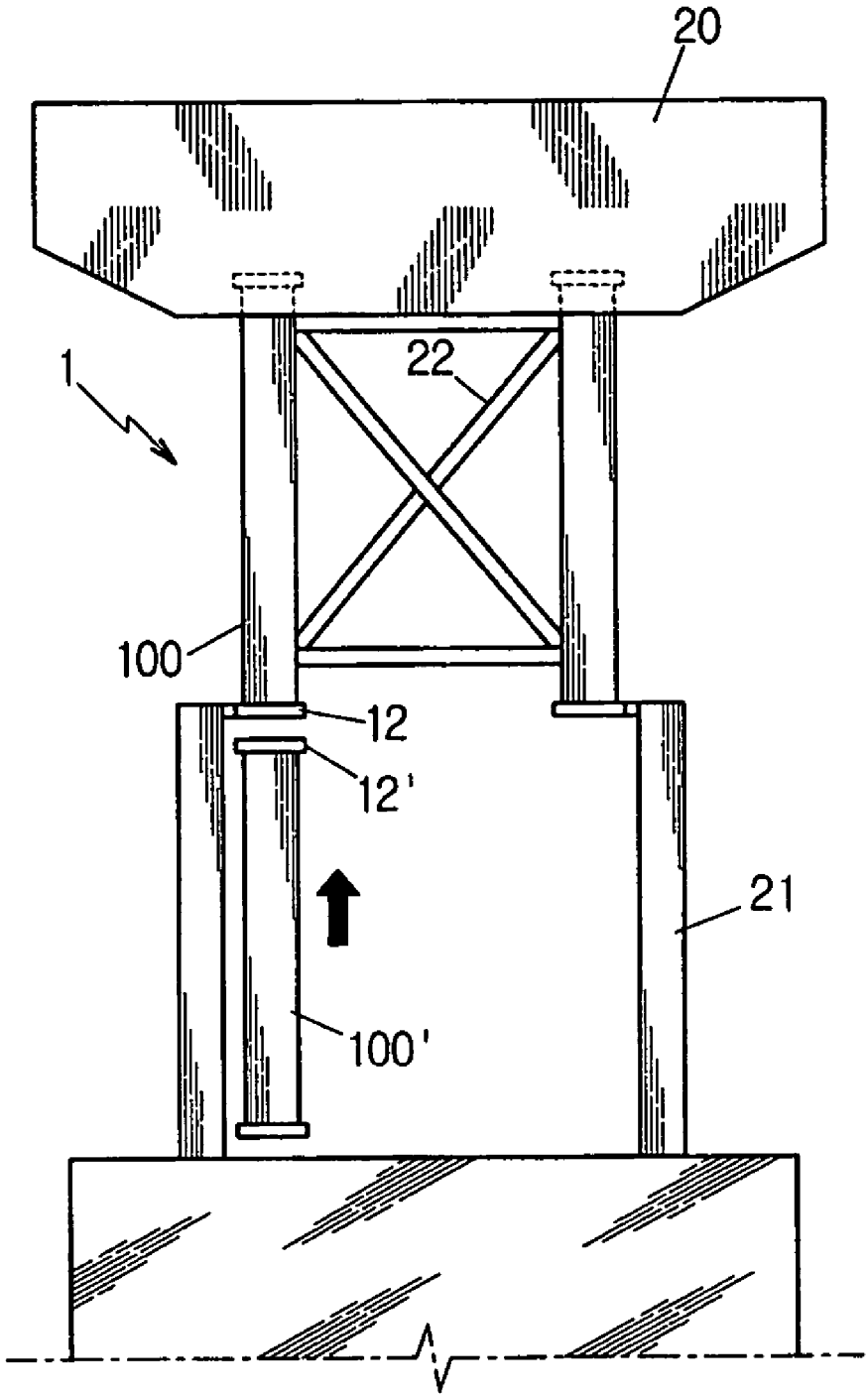
FIG. 10 is a front view illustrating a state where another prefabricated segmental concrete filled tube member is installed under the segmental concrete filled tube member installed under the coping part as shown in FIG. 9.

FIGS. 8 to 10 are views sequentially showing a fabrication method using the prefabricated segmental concrete filled tube members of the present invention.

First, as shown in FIG. 8, a coping part 20 of the upper portion of the bridge pier is executed, and lifted by a support 23. In this case, the coping part 20 is lifted to at least a height equivalent to a length of at least one prefabricated segmental concrete filled tube member 100 so as to easily install the segmental concrete filled tube member 100 under the coping part 20.

After the coping part 20 is lifted, as shown in FIG. 9, a prefabricated segmental concrete filled tube member 100 prepared in a factory is installed under the coping part 20.

After the segmental concrete filled tube member 100 is installed under the coping part 20, as shown in FIG. 10, the segmental concrete filled tube member 100 on the coping part 20 is lifted by a jack device 21 and another prefabricated segmental concrete filled tube member 100' is connected and installed under the former segmental concrete filled tube member 100. In this case, the connection is carried out in such a way that the adjacent connection flanges 12 and 12' of the adjacent prefabricated segmental concrete filled tube member 100 and 100' are brought in contact with each other and connected together.

After the connection flanges 12 are connected, a filler material is injected into an injection hole 14 formed by grooves 13 provided on the opposite surfaces of the connection flanges 12 and 12', respectively, to fill the micro space between the concretes filled in the segmental concrete filled tube members 100 and 100'. Since the injection method of the filler material has been described in detail in FIGS. 3 and 4, the detailed explanation thereof will be omitted.

Meanwhile, if the height of the pier becomes higher than that of fabrication structure 1 formed by the connection of the segmental concrete filled tube members 100 and 100', the segmental concrete filled tube member 100' is lifted to a certain height by the jack device 21, and the above steps are repeated to install one segmental concrete filled tube member under another segmental concrete filled tube member, thereby completing a fabrication structure 1 supporting the coping part 20. In this case, a bracing 22 can be installed in order to reinforce in lateral direction of the fabrication structure 1. Although the segmental concrete filled tube members 100 shown in FIGS. 8-10 are not provided with the tendon 216, by using the prefabricated segmental concrete filled tube member 200 having the tendon 216 therein as shown in FIG. 6, if necessary, the tendon is prestressed to apply a prestress to the fabrication structure 1.

In the mean time, the above-mentioned fabrication method of the prefabricated segmental concrete filled tube members of the invention is merely one exemplary embodiment, so it can be variously modified by the skilled in the art. For example, by using a crane instead of the support and the jack device, the coping part of the upper portion of the pier is lifted, and the prefabricated segmental concrete filled tube members are serially assembled into one. Although the prefabricated segmental concrete filled tube members have been downwardly assembled one by one in a state where the coping part has been lifted, the prefabricated segmental concrete filled tube members can be upwardly assembled from the ground to a desired level one by one to build a fabrication structure, and a coping part of the upper portion of the pier can be placed on the fabrication structure.

Figure 11:
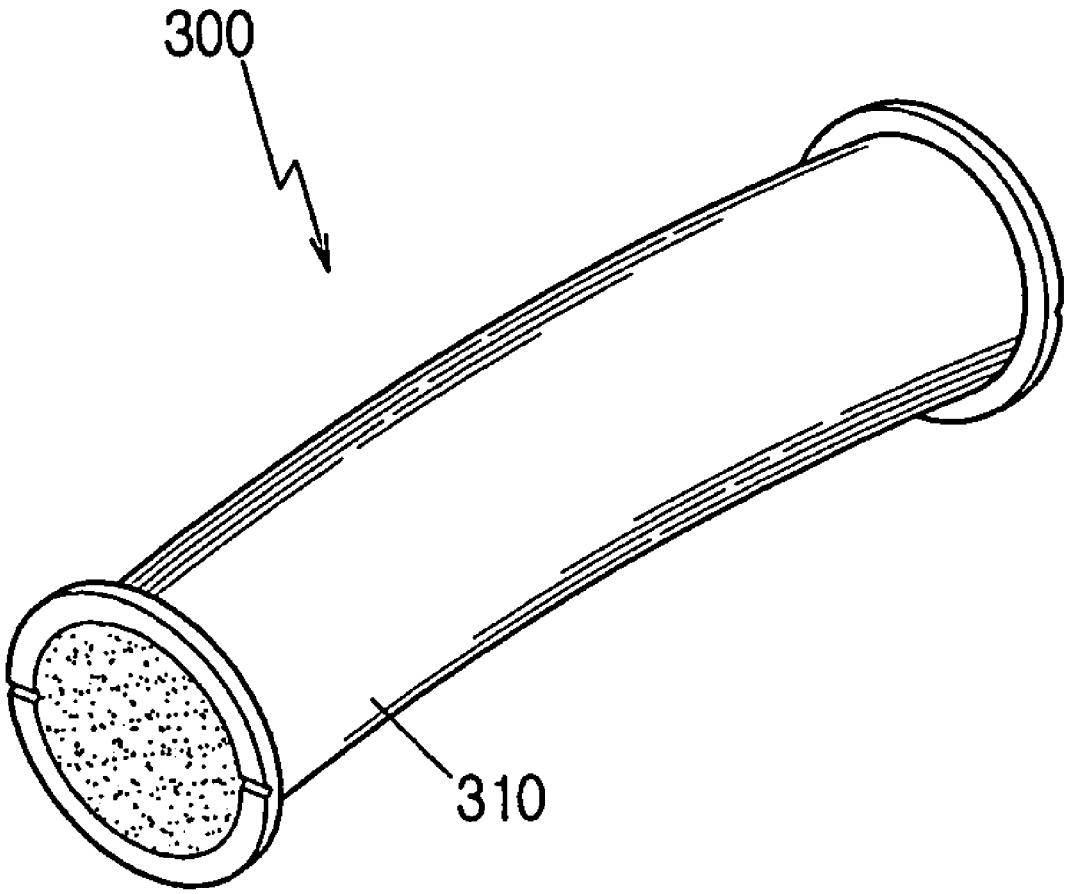
FIG. 11 is a perspective view of a prefabricated segmental concrete filled tube member according to still another preferred embodiment of the present invention.

FIG. 11 is a perspective view illustrating a prefabricated segmental concrete filled tube member 300 according to another preferred embodiment of the present invention.

Figure 12:
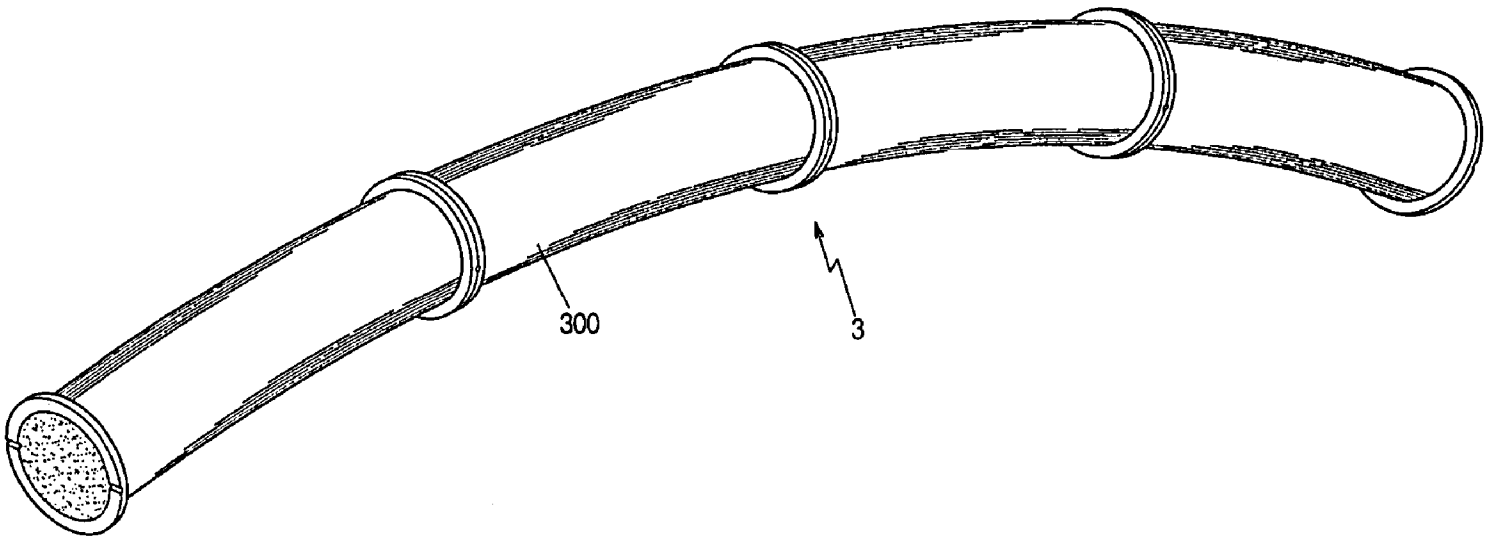
FIG. 12 is a perspective view illustrating a state where the segmental concrete filled tube members of FIG. 11 are connected with each other.

The present embodiment is different from the embodiment in FIG. 5 in that a pipe is bent with a radius of curvature. Like this, when the pipe 310 constituting the prefabricated segmental concrete filled tube member 300 is fabricated in bent shape, an arch type fabrication structure can be obtained in connection of the segmental concrete filled tube members 300 together. FIG. 12 shows an arch type fabrication structure formed by the connection of such prefabricated segmental concrete filled tube members 300.

Referring to FIG. 12, since the fabrication structure 3 is formed in an arch type by the connection of the segmental concrete filled tube members 300 bent in a radius of curvature, it can be adapted to a location where a bending load and an axial load are applied simultaneously. Meanwhile, the arch type fabrication structure 3 shown in FIG. 12 is merely exemplary one structure simultaneously applied with the bending load and the axial load, so the prefabricated segmental concrete filled tube member 300 of the present invention can be adapted to various shaped other structures. Although the segmental concrete filled tube member 300 shown in FIGS. 11 and 12 is not provided with the tendon 216, if necessary, as shown in FIG. 6, the sheath tube 215 may be installed in the concrete 211, and the tendon 216 may be disposed therein, thereby introducing a prestress to the fabrication structure 3.

As set forth before, according to the present invention, a fabrication structure can be built in such a way that the prefabricated segmental concrete filled tube members in unit type with pipe filled with concrete are prefabricated in a factory, transported to the construction field, and securely assembled with simple method.

Like this, in the present invention, the prefabricated segmental concrete filled tube members are prefabricated in the factory, and assembled in the construction field, so that complicated in-site works can be minimized to thus considerably shorten the term of works in comparison with that of the conventional in-site cast concrete pillar.

In addition, in the in-site connection and assembly of the prefabricated segmental concrete filled tube members, the segmental concrete filled tube members are assembled in series, being lifted from the ground, so that the execution works at a high altitude can be prevented and safe, economical execution can be carried out.

In particular, the prefabricated segmental concrete filled tube member of the present invention is reinforced by the composition operation between the outer pipe and the inner concrete to thus reduce a cross section of the pillar structure, thereby providing effects of reduction in material cost, an extensive view, an aesthetic design and so on.

In addition, the prefabricated segmental concrete filled tube member of the invention can be provided therein with the tendon so that static and dynamic performance of the fabrication structure can be considerably increased with the installation and prestress of the tendon.

In addition, in the prefabricated segmental concrete filled tube member of the present invention, for the pillar structure such as high bridge pier in which a bending force is dominant over an axial force, a distance between the prefabricated segmental concrete filled tube members is merely further enlarged so that a bending stress thereof can be enlarged without increase of an axial force thereof by a dead load, thereby obtaining economical execution through an optimum design.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method of supporting a bridge, comprising the steps of:

(a) lifting a prefabricated coping part of the upper portion of a bridge pier;

(b) installing a prefabricated segmental concrete filled tube member under the coping part, the segmental concrete filled tube member including a hollow pipe filled therein with concrete, and a connection flange radially extending from the peripheries of both ends of the pipe;

(c) installing another prefabricated segmental concrete filled tube member under the former prefabricated segmental concrete filled tube member to connect each other such that the connection flange of the latter segmental concrete filled tube member brings in contact with that of the former segmental concrete filled tube member;

(d) injecting a filler material into an injection hole formed by grooves provided on opposite surfaces of the connection flanges, respectively; and (e) repeating the steps (c) and (d).

* * * * *